US009387910B2

(12) United States Patent
Isaac

(10) Patent No.: US 9,387,910 B2
(45) Date of Patent: Jul. 12, 2016

(54) MOORING SYSTEM FOR PERSONAL WATERCRAFT

(71) Applicant: Troy Isaac, Sault Ste. Marie (CA)

(72) Inventor: Troy Isaac, Sault Ste. Marie (CA)

( * ) Notice: Subject to any disclaimer, the term of this patent is extended or adjusted under 35 U.S.C. 154(b) by 0 days.

(21) Appl. No.: 14/518,631

(22) Filed: Oct. 20, 2014

(65) Prior Publication Data

US 2015/0114275 A1 Apr. 30, 2015

Related U.S. Application Data

(60) Provisional application No. 61/894,951, filed on Oct. 24, 2013.

(51) Int. Cl.

| | |
|---|---|
| ***B63B 21/50*** | (2006.01) |
| ***B63B 21/04*** | (2006.01) |
| ***B63B 35/73*** | (2006.01) |
| *E02B 3/24* | (2006.01) |

(52) U.S. Cl.

CPC ..... *B63B 21/50* (2013.01); *B63B 21/04* (2013.01); *B63B 35/731* (2013.01); *E02B 3/24* (2013.01)

(58) Field of Classification Search

CPC ..... B63B 21/04; B63B 21/50; E02B 3/26
USPC ..... 114/230.15, 230.18, 230.2, 230.26, 219
See application file for complete search history.

(56) References Cited

U.S. PATENT DOCUMENTS

| | | | | |
|---|---|---|---|---|
| 3,964,422 | A * | 6/1976 | Boyd | E02B 3/26 114/219 |
| 4,627,375 | A * | 12/1986 | Davis | B63B 21/00 114/219 |
| 4,656,961 | A * | 4/1987 | Hellkamp | B63B 21/00 114/230.18 |
| 5,645,005 | A * | 7/1997 | Golland | B63B 21/00 114/230.2 |
| 6,357,378 | B1 * | 3/2002 | Hile | B63B 21/00 114/230.2 |
| 2006/0042533 | A1 * | 3/2006 | Munro | B63B 21/00 114/230.15 |

* cited by examiner

*Primary Examiner* — Lars A Olson

(57) ABSTRACT

A mooring system for a personal watercraft includes a bow bracket, a console bracket and a stern bracket. The bow bracket is secured to the bow of the craft. The console bracket is secured to the console of the craft. The stern bracket is secured to the stern of the craft.

11 Claims, 10 Drawing Sheets

MOORING SYSTEM FOR PERSONAL WATERCRAFT

This document claims the benefit of U.S. provisional patent application Ser. No. 61/894,951 filed on 24 Oct. 2013, the full disclosure of which is incorporated herein by reference.

TECHNICAL FIELD

This document relates generally to the field of personal watercraft and, more particularly, to a mooring system for a personal watercraft incorporating a series of brackets that are also used to hold equipment and accessories in a secure manner.

BACKGROUND

Personal watercraft (PWC) have experienced an increase in popularity over the years. As PWC have evolved, deck size has increased and many PWC now accommodate as many as three people on board. Significantly, larger PWC require a more effect mooring system. Further, while PWC have increased in size, storage space and equipment mounting options have not kept pace. This document relates to an efficient and effective mooring system for a personal watercraft that incorporates various brackets that also function to mount and securely hold equipment and accessories so that they will not be lost and/or damaged by the operator and any passengers during operation of the PWC.

SUMMARY

In accordance with the purposes, benefits and advantages set forth herein, a mooring system is provided for a personal watercraft. The mooring system includes a bow bracket secured to a bow of the personal watercraft, a console bracket secured to a console of the personal watercraft and a stern bracket secured to a stern of the personal watercraft. The mooring system further includes a first mooring line having a first proximal end connected to the bow bracket, a second mooring line having a second proximal end connected to the console bracket and a third mooring line having a third proximal end connected to the stern bracket.

The mooring system further includes a buoy line including at least one buoy. In one possible embodiment the buoy line includes two buoys. In another possible embodiment the buoy line includes three buoys. In yet another possible embodiment the buoy line includes more than three buoys. In any of the embodiments the buoy line has a first end line connected to the bow bracket and a second end line connected to the stern bracket.

A bow bracket for a personal watercraft includes a center plate and a loop element secured to the mounting plate. In one possible embodiment the center plate is V-shaped in profile. The V-shaped center bracket defines an included angle of between about 80 and about 150 degrees adapted to receive a forward edge of the personal watercraft. In addition the bow bracket includes a first set of fasteners and an accessory secured to the loop element by the first set of fasteners. In one possible embodiment the accessory is a navigation light for the watercraft.

A console bracket for a personal watercraft includes, a loop element and a first fastener for securing the loop element to one of handle bars and console of the personal watercraft. The console bracket further includes a second fastener and an accessory secured to the loop element by the second fastener.

The accessory may be selected from a group consisting of a radio, a light, a depth finder, a GPS, a sonar and combinations thereof.

A mooring system is provided for a personal watercraft. The mooring system comprises a bow bracket secured to a bow of said personal watercraft, a handle bar bracket secured to a console of the personal watercraft, and a stern bracket secured to a stern of the personal watercraft, wherein the bow bracket includes a first loop element, and wherein the bow bracket holds a light on the first loop element.

A bow bracket for a personal watercraft is provided. The bow bracket comprises a center plate, and a loop element secured to the center plate, wherein the center plate is V-shaped, and wherein the V-shaped center plate defines an included angle of between about 80 and about 150 degrees adapted to receive a forward edge of the personal watercraft.

A handle bar bracket for a personal watercraft is provided. The handle bar bracket comprises a loop element, and a first fastener for securing the loop element to one of handle bars and console of said personal watercraft, wherein the handle bar bracket comprises a second fastener and an accessory secured to the loop element by the second fastener, and wherein the accessory is selected from a group consisting of a radio, a light, a depth finder, a GPS, a sonar, a rod holder and combinations thereof.

In the following description there is shown and described several different embodiments of a mooring system including a bow bracket and a console bracket. As it should be realized, the mooring system, bow bracket and console bracket are all capable of other different embodiments and their several details are capable of modification in various, obvious aspects. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the mooring system, bow bracket and console bracket and together with the description serve to explain certain principles thereof. In the drawings.

Reference will now be made in detail to the present preferred embodiments of the mooring system, bow bracket and console bracket, examples of which are illustrated in the accompanying drawings.

DETAILED DESCRIPTION

Figure 1:
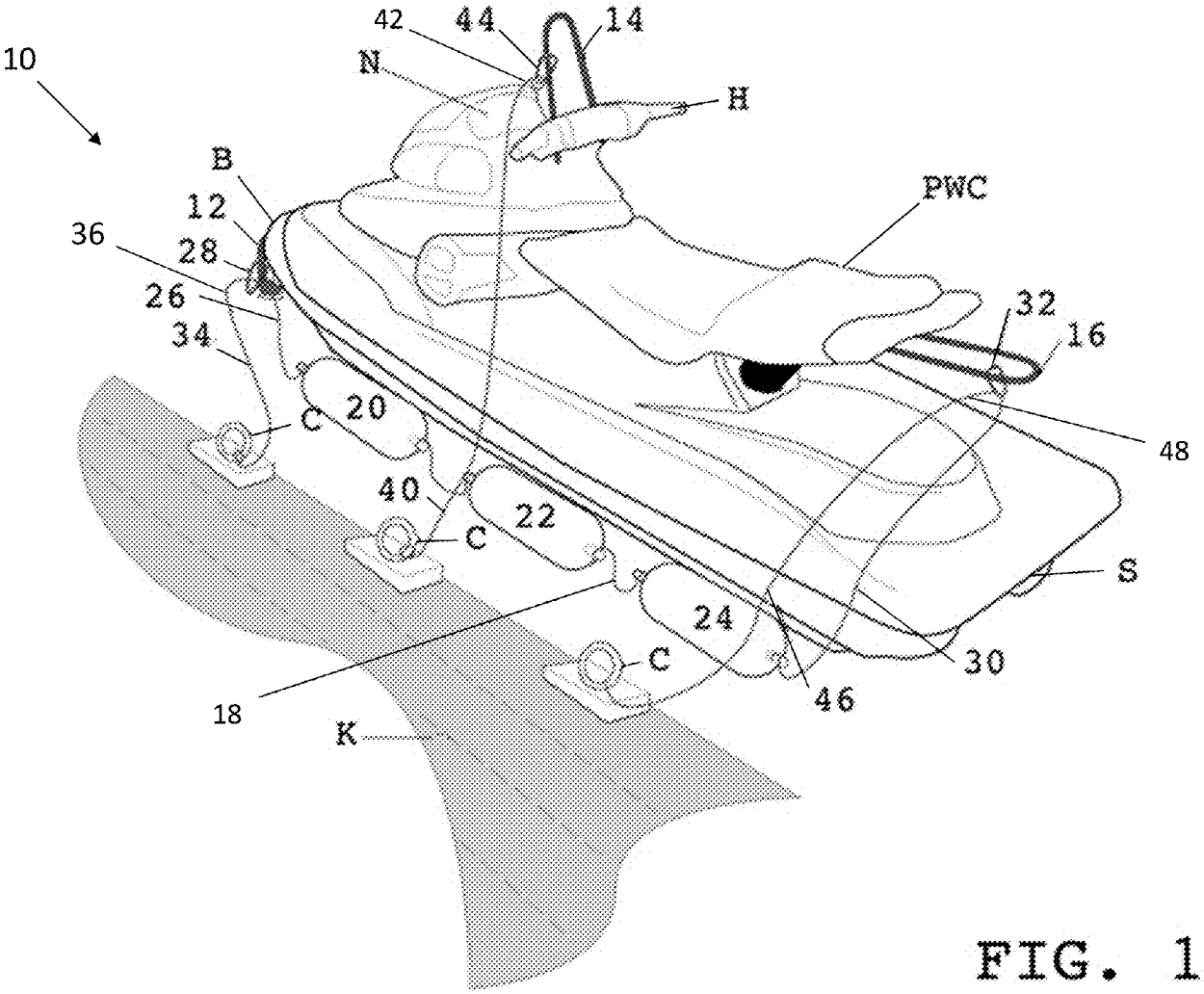
FIG. 1 is a perspective view of a personal watercraft equipped with the current mooring system.
Figure 2:
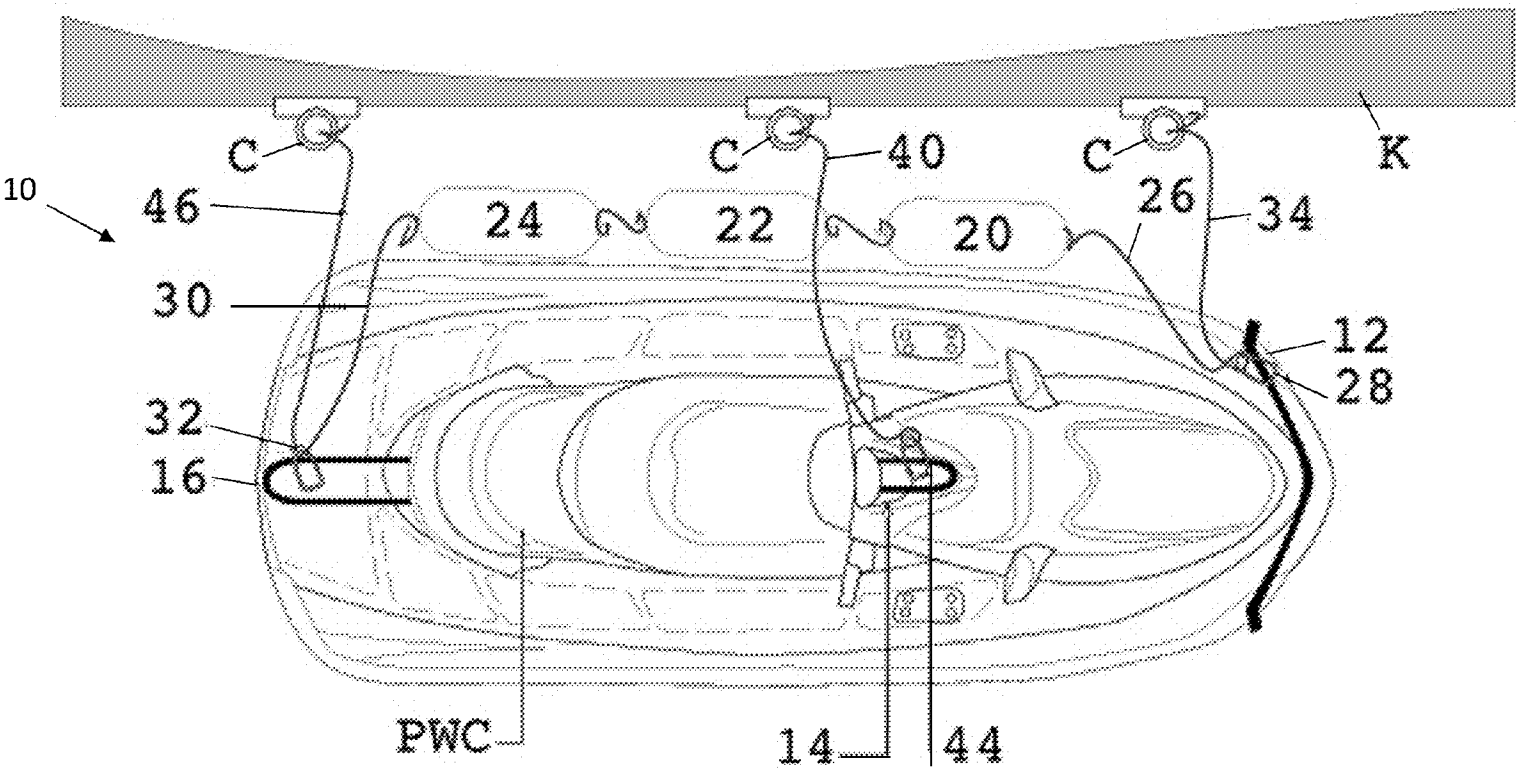
FIG. 2 is a top plan view of a personal watercraft equipped with the current mooring system illustrated in FIG. 1.

Reference is now made to FIGS. 1 and 2 generally showing the mooring system 10 which includes a bow bracket 12, a console bracket 14 and a stern bracket 16. As illustrated the bow bracket 12 is connected to the bow B of the personal watercraft (PWC). The console bracket 14 is connected to the console N of the personal watercraft either directly or through the handlebars H by which the personal watercraft (PWC) is steered which extend through the console N. The stern bracket 16 is connected to the stern S of personal watercraft (PWC). For purposes of this document the "stern" broadly includes the rear of the body R, the rear deck D and the transom T. Thus, it should be appreciated that the stern bracket may be connected to any of these structures at the rear or stern of the personal watercraft (PWC). See also FIGS. 6*a*-6*j*.

The mooring system 10 further includes a buoy line system 18. In the illustrated embodiment the buoy line 18 includes the buoy 20, the buoy 22 and the buoy 24. While three buoys 20, 22, 24 are illustrated, it should be appreciated that the buoy line 18 may include substantially any number such as one, two, three or more buoys as desired by the operator.

The buoy line 18 includes a first end line 26 that is secured by karabiner or other fastener 28 to the bow bracket 12. Further the buoy line 18 includes a second end line 30 that is secured by a karabiner or other fastener 32 to the stern bracket 16. When properly secured in position, the buoy line 18 runs along one side of the personal watercraft (PWC) with the buoys 20, 22, 24 on the surface of the water resting aligned with and adjacent to the side of the personal watercraft (PWC).

A first mooring line 34 has a proximal end 36 that is secured by means of the fastener 28 to the bow bracket 12. A second mooring line 40 has a proximal end 42 that is secured by the karabiner or fastener 44 to the console bracket 14. A third mooring line 46 has a proximal end 48 that is secured to the stern bracket 16 by means of the fastener 32. When moored to a dock K, the distal ends of the respective mooring lines 34, 40, 46 are tied or otherwise secured to cleats C of a dock K. As should be appreciated, the buoy line 18 extends along the side of the personal watercraft (PWC) between the personal watercraft and the dock K. Thus the buoys 20, 22, 24 are positioned between the personal watercraft (PWC) and the dock K where they protect the (PWC) from rubbing against the dock. At the same time the three mooring lines 34, 40, 46 ensure that the personal watercraft (PWC) is properly secured in position at the dock K in an efficient and effective manner.

Figure 3:
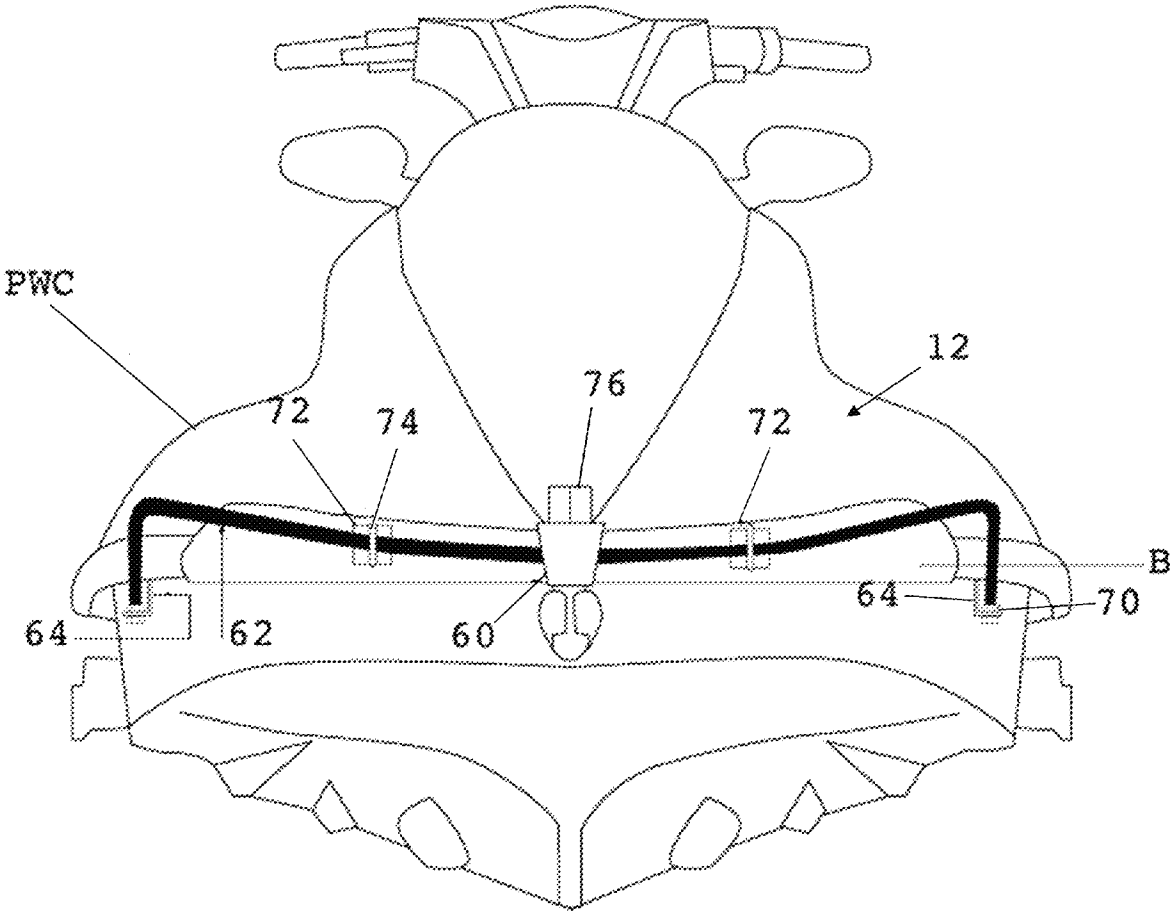
FIG. 3 is a front elevational view of a first embodiment of bow bracket.
Figure 4A:
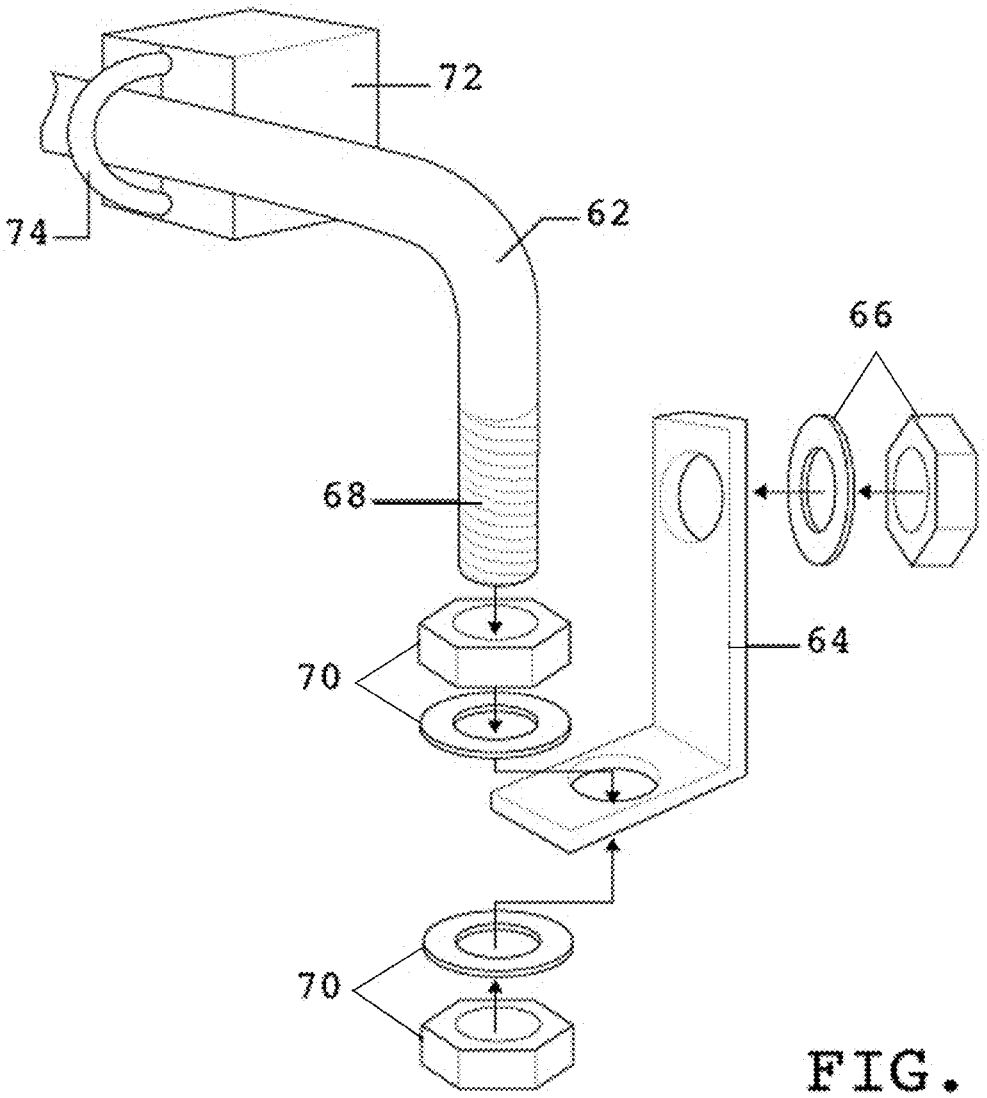
FIGS. 4*a* and 4*b* are detailed exploded perspective views of two possible embodiments of bow brackets secured to the bow of a personal watercraft.

As illustrated in FIGS. 3 and 4*a*, the bow bracket 12 includes a center plate 60 that is secured to a rod, loop or bumper element 62. The center plate 60 has a v-shaped profile that defines an included angle of between 80 and 150 degrees that is adapted to receive and extend over the forward edge of the personal watercraft PWC when the bow bracket 12 is properly mounted in position.

The bow bracket 12 is secured to the personal watercraft PWC by means of two L-shaped mounting brackets 64. The mounting brackets 64 are secured to the personal watercraft PWC by washers and nuts 66 on two existing bolts (not shown). As illustrated, the bumper element 62 includes threaded ends 68 which are secured to the mounting brackets 64 by means of cooperating nuts and bolts 70.

Figure 4B:
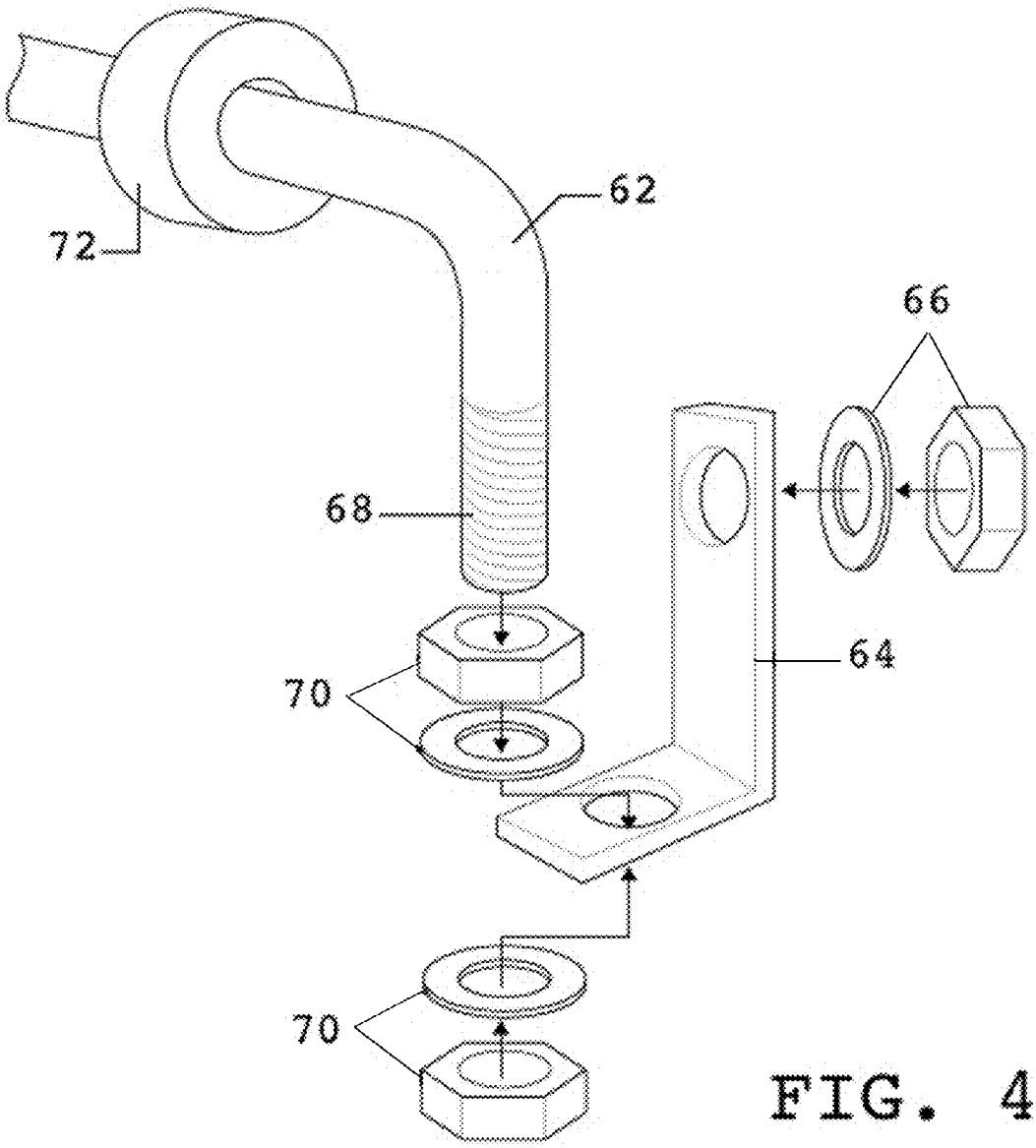
Figure 5B:
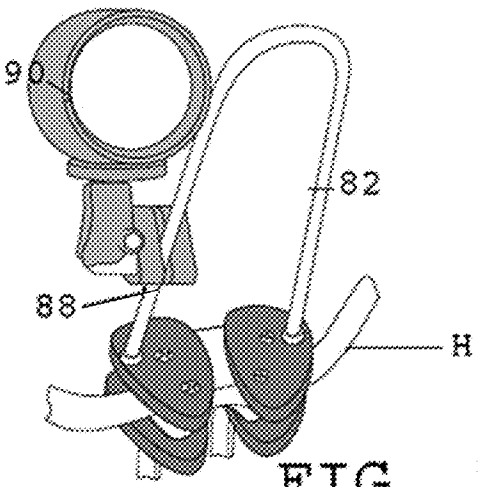
FIGS. 5*a*-5*d* are detailed perspective views of various embodiments of console brackets all mounted to the handlebars of a personal watercraft.
Figure 5A:
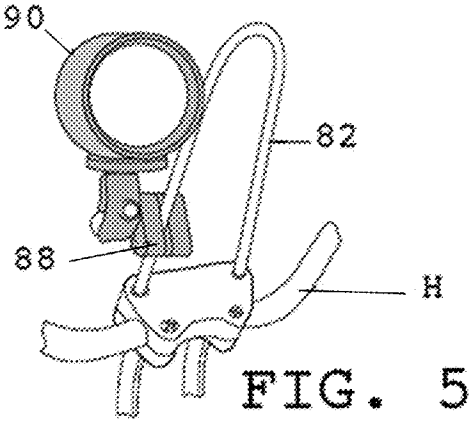
Figure 5D:
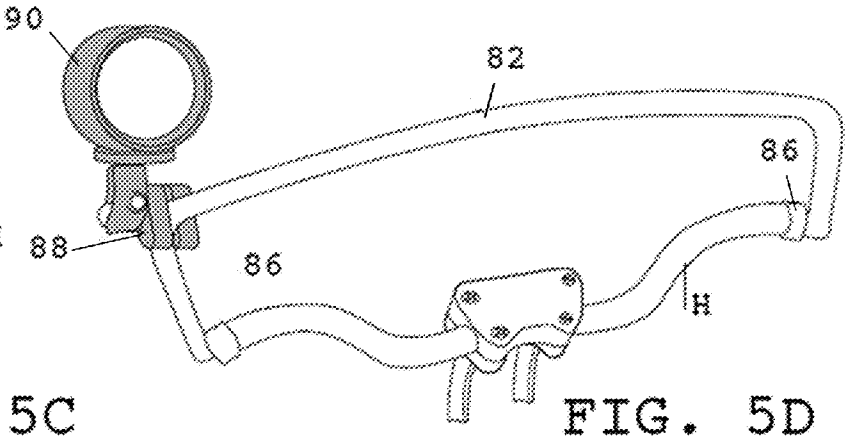
Figure 5C:
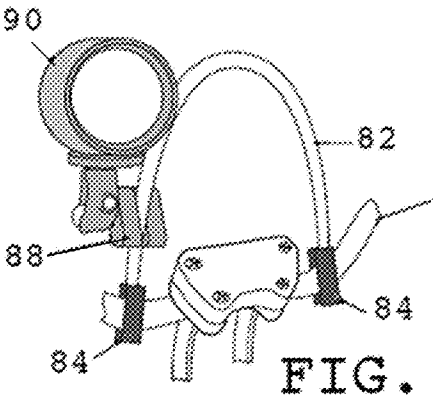

Two resilient spacers 72 are provided on the bumper element 62 between the center bracket 60 and the mounting brackets 64. In the embodiment illustrated in FIG. 4*a*, the resilient spacers 72 are in the form of blocks secured to the bumper element 62 by means of U-shaped fasteners 74. In the alternative embodiment illustrated in FIG. 4*b*, the resilient spacers 72 are simple grommets. In either embodiment, the resilient spacers 72 help protect the bow B from damage. They also relieve stress on the mounting brackets 64 in the event of low speed contact between the bumper element 62 and a dock K or other structure.

In any of the embodiments, an accessory, such as a navigation light 76 may be mounted to the center bracket 60 or other structure of the bow bracket 12.

Various embodiments of console brackets 14 are illustrated in detail in FIGS. 5*a*-5*d*. The console bracket 14 of FIG. 5*a* includes a loop element 82. In the illustrated embodiment the loop element 82 is substantially U-shaped. It should be appreciated, however, that the loop element 82 may assume substantially any shape. In the embodiment illustrated in FIG. 5*a*, the ends of the loop element 82 are threaded. Those ends are received in the existing handle bar mount M on the personal watercraft PWC and secured in position by cooperating washers and nuts (not shown). In the FIG. 5*b* embodiment, the loop element 82 is secured in position by several nuts and washers compressing the top and bottom plates with a possible tubular spacer positioned on the inside of the 2 plates for the outside nuts to apply pressure securing the integrity of the assembly. In the FIG. 5*c* embodiment, the loop element 82 is secured in position by handle bar clips 84 connected to the ends of the loop. Finally, in the FIG. 5*d* embodiment fasteners 86 on the ends of the loop element 82 securely engage and hold the ends of the handle bars H. In any of the embodiments 5*a*-5*d*, fasteners and mounting brackets 88 of substantially any appropriate type known in the art may be utilized to mount an accessory 90 to the console bracket 14. The accessory 90 may be a radio, a light, a depth finder, a GPS, a sonar, any other equipment or accessory desired by a personal watercraft operator and combinations thereof if desired.

Figure 6A:
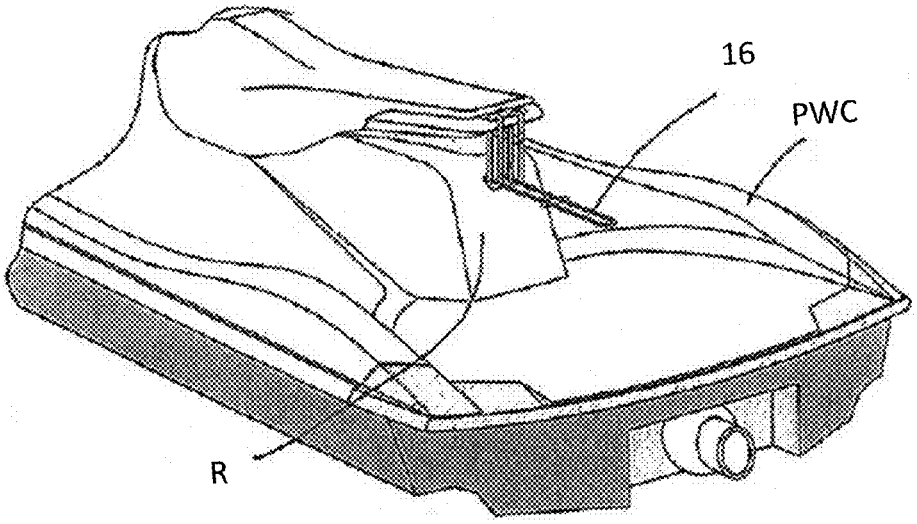
FIGS. 6*a*-6*c* are detailed views of various embodiments of stern brackets.
Figure 6B:
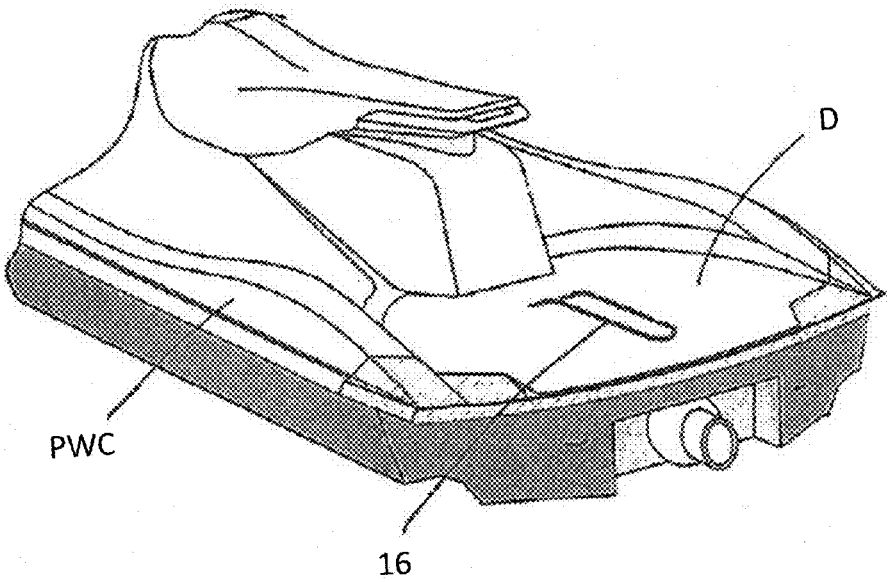
Figure 6C:
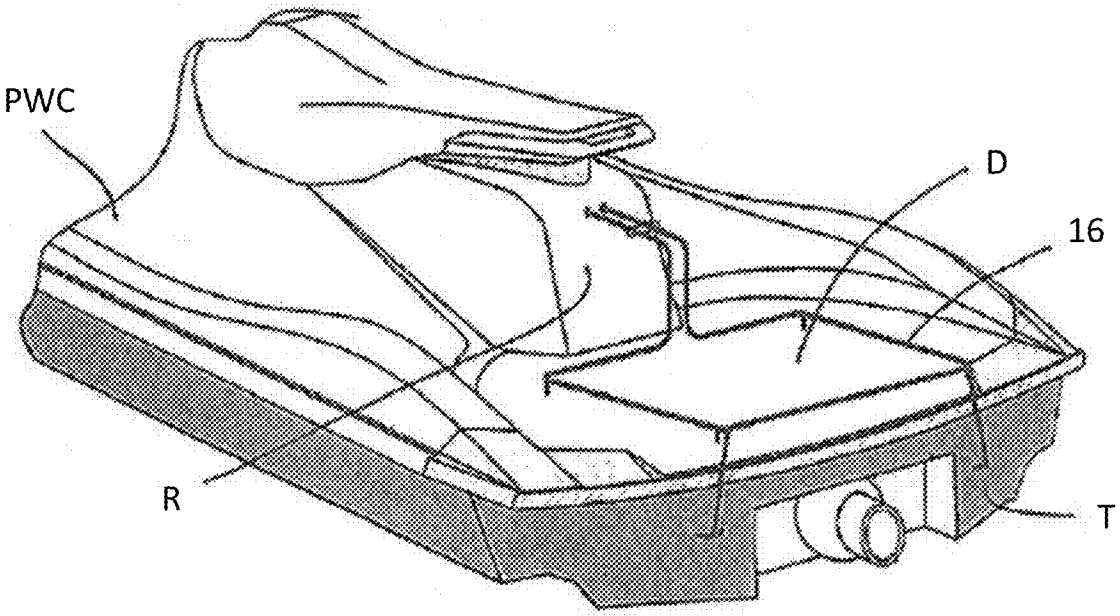

As illustrated in FIGS. 6*a*-6*c*, the stern bracket 16 may assume a number of different configurations that are connected to the personal watercraft (PWC) at the rear of the body R, on the Deck D and/or at the transom T as may be appropriate. Additional details with respect to the stern bracket 16 may be found in co-pending U.S. patent application Ser. No. 13/685,921, filed on 27 Nov. 2012 and entitled BRACKET FOR A PWC, the full disclosure which is incorporated herein by reference.

Figure 7:
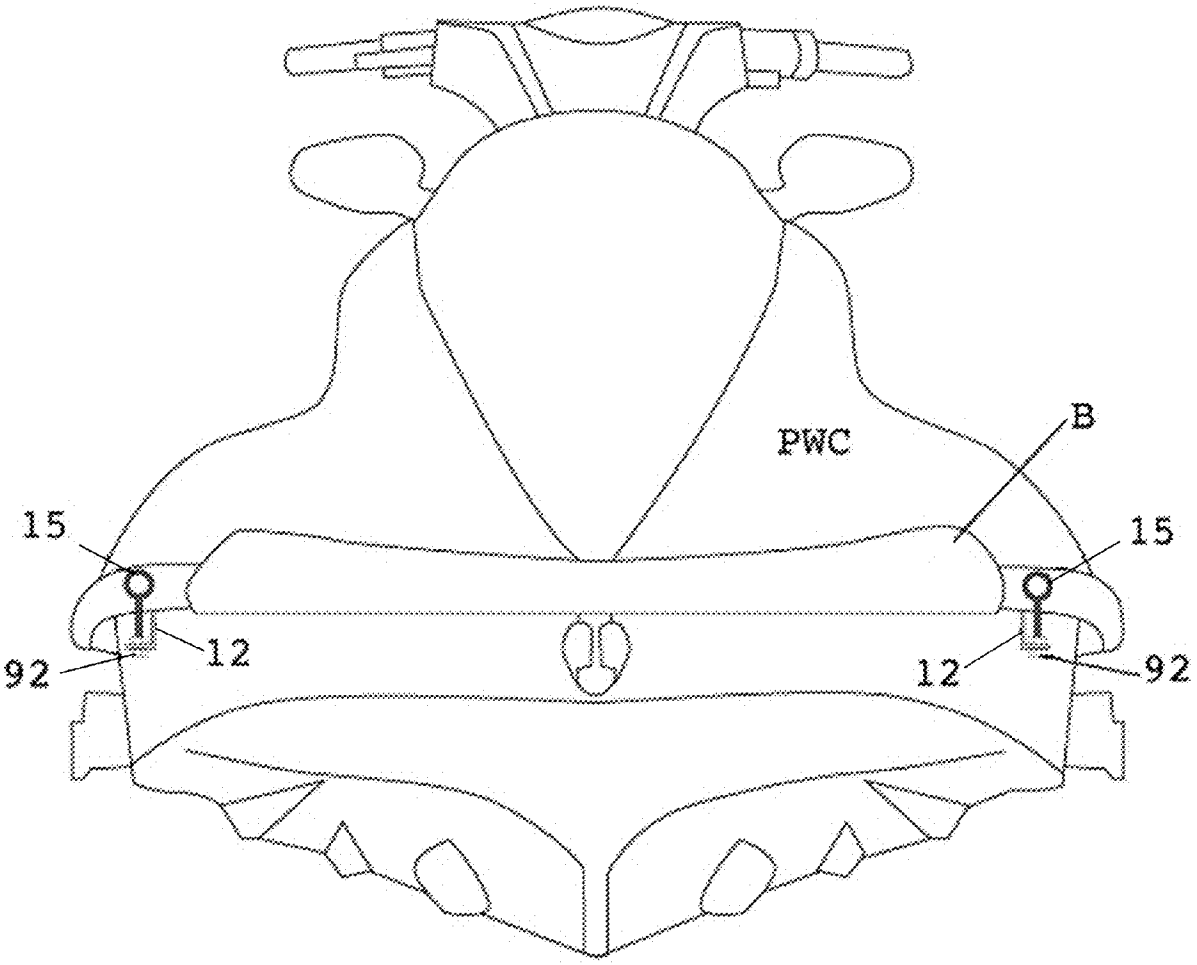
FIG. 7 is a front elevational view of an alternative mooring system embodiment.

FIG. 7 includes an additional embodiment incorporating a bow bracket 12 spaced on each side of the center line of the PWC. Each bow bracket 12 is secured to the bow B of the PWC by a bolt or other fastener (not shown). This includes using existing bolts on the personal watercraft PWC and cooperating nuts and bolts in the same manner as the L-shaped mounting brackets 64 described earlier in this document. Each bracket 12 also includes a mooring line loop 15 secured to the bracket by cooperating washers and nuts 92.

Figure 8:
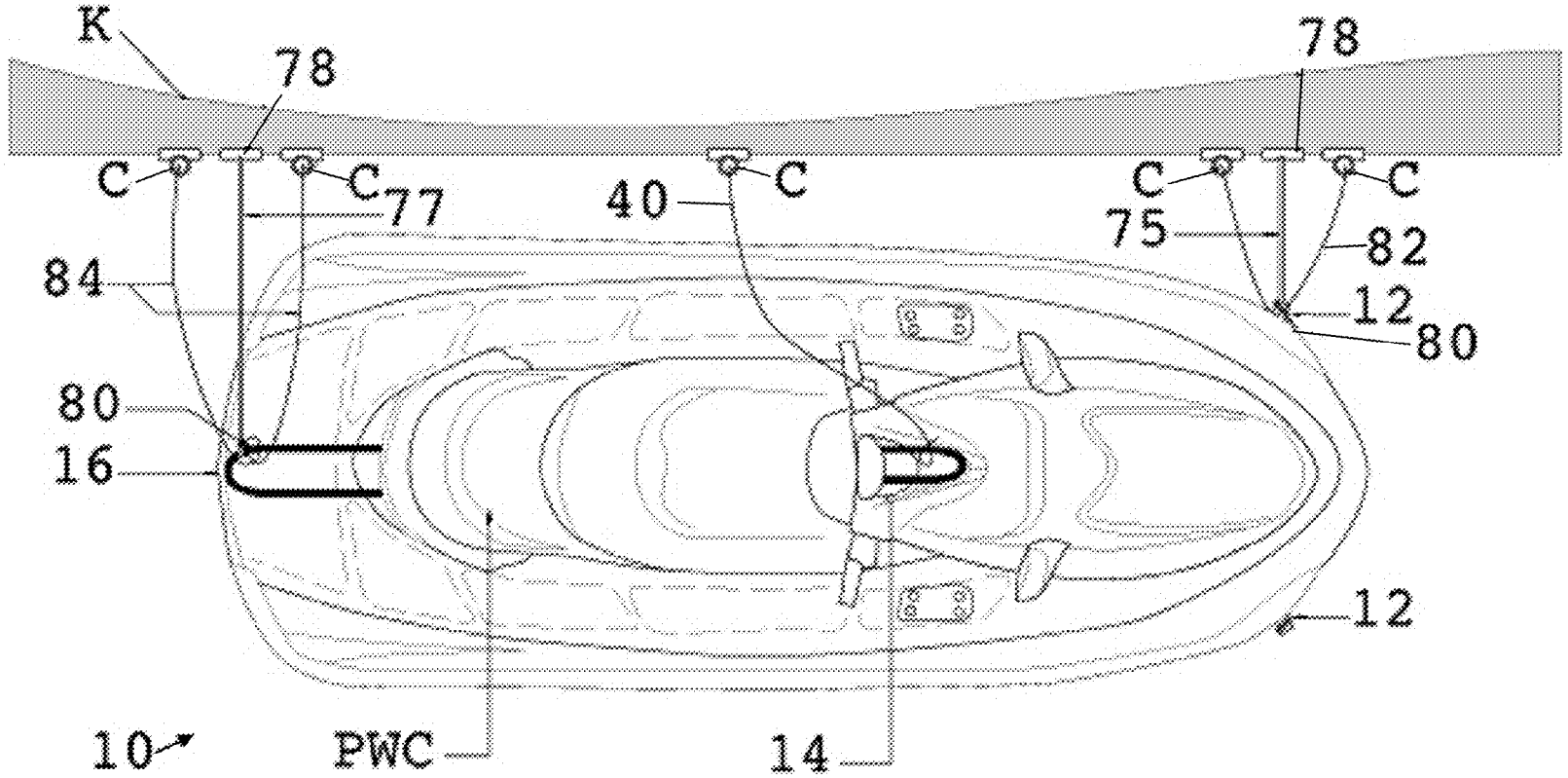
FIG. 8 is a top plan view of the alternative mooring system embodiment illustrated in FIG. 7.

An alternative embodiment of the mooring system 10' is illustrated in FIG. 8. As illustrated, the mooring system 10' includes the bow bracket 12 of FIG. 7 and the console bracket 14 and stern bracket 16 of FIG. 2. A first, rigid spacer bar 75 extends between the dock K and the bow bracket 12. A second, rigid spacer bar 77 extends between the dock K and the stern bracket 16. The spacer bars 75, 77 may be mounted by hinges 78 to the dock K. Thus, when not in use they simply hinge down and out of the way up against the dock. The distal ends of the spacer bars 75, 77 may include a resilient snap fastener 80 that will provide a resilient snap-lock engagement with the bow and stern brackets 12, 16.

Two rubber straps or lines 82 are connected between the bow bracket 12 and two of the cleats C on the dock K beside the first spacer bar 75. Similarly, two rubber straps or lines 84 are connected between the stern bracket 16 and two other cleats C on the dock K beside the second spacer bar 77. The lines 82, 84 help secure the PWC in position by the dock K (i.e. provide a tension force toward the dock) while the spacer bars 75, 77 hold the PWC away from the dock K so that the PWC will not rub on the dock and damage the finish on the PWC. If desired, the buoy line system 18 described above could also be used with this embodiment.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. A mooring system for a personal watercraft, comprising:

a bow bracket secured to a bow of said personal watercraft;

a handle bar bracket secured to a console of said personal watercraft; and a stern bracket to a stern of said personal watercraft, wherein said bow bracket includes a first loop element, and wherein said bow bracket holds a light on said first loop element.

2. The mooring system of claim 1 further including a first mooring line having a first proximal end connected to said bow bracket, a second mooring line having a second proximal end connected to said handle bar bracket and a third mooring line having a third proximal end connected to said stern bracket.

3. The mooring system of claim 2 further including a buoy line including at least one buoy.

4. The mooring system of claim 3, wherein said buoy line has a first end connected to said bow bracket and a second end connected to said stern bracket.

5. The mooring system of claim 1, wherein said console handle bar bracket includes a second loop element.

6. The mooring system of claim 1, wherein said handle bar bracket holds an accessory on said second loop element.

7. The mooring system of claim 1, wherein said bow bracket further includes a center plate having a V-shape for engaging a forward edge of said personal watercraft.

8. A bow bracket for a personal watercraft, comprising:

a center plate; and a loop element secured to said center plate, wherein said center plate is V-shaped, and wherein said V-shaped center plate defines an included angle of between about 80 and about 150 degrees adapted to receive a forward edge of the personal watercraft.

9. The bow bracket of claim 8, further including a first set of fasteners and an accessory secured to said loop element by said first set of fasteners.

10. The bow bracket of claim 9, wherein said accessory is a light.

11. A handle bar bracket for a personal watercraft, comprising:

a loop element; and a first fastener for securing said loop element to one of handle bars and console of said personal watercraft, wherein the handle bar bracket comprises a second fastener and an accessory secured to said loop element by said second fastener, and wherein said accessory is selected from a group consisting of a radio, a light, a depth finder, a GPS, a sonar, a rod holder and combinations thereof.

* * * * *